US005181346A

United States Patent [19]

Paliwoda et al.

[11] Patent Number: 5,181,346

[45] Date of Patent: Jan. 26, 1993

[54] THRU-FEED LAPPING APPARATUS

[75] Inventors: Joseph Paliwoda, West Bloomfield; Robert B. Casadonte, Clawson; Ronald R. Reinke, Drayton Plains, all of Mich.

[73] Assignee: Deco-Grand, Inc., Royal Oak, Mich.

[21] Appl. No.: 566,482

[22] Filed: Aug. 13, 1990

[51] Int. Cl.[5] ..... B24B 1/00; B24B 7/04

[52] U.S. Cl. ..... 51/327; 51/110; 51/128; 51/215 R

[58] Field of Search ..... 51/109 R, 103 WH, 110, 51/131.2, 131.3, 165.77, 165.9, 215 R, 215 E, 215 M, 215 UE, 283 R, 326, 327, 292; 198/345.1, 463.4, 530, 532; 414/222, 224, 225

[56] References Cited

U.S. PATENT DOCUMENTS

| | | | |
|---|---|---|---|
| 1,388,395 | 8/1921 | Witt | 51/110 |
| 1,599,374 | 9/1926 | Skillings | 51/131.3 |
| 1,628,618 | 5/1927 | Spencer | 51/131.3 |
| 2,056,182 | 10/1936 | Gardner | 51/110 |
| 2,636,322 | 4/1953 | Carlson et al. | 51/215 M |
| 3,903,651 | 9/1975 | Suzuki et al. | 51/110 |
| 4,001,983 | 1/1977 | Favrot | 51/215 UE |
| 4,043,767 | 8/1977 | Suda | 51/103 WH |
| 4,331,228 | 5/1982 | Galarowic | 198/345.1 |

*Primary Examiner*—Bruce M. Kisliuk
*Assistant Examiner*—Bryan Reichenbach
*Attorney, Agent, or Firm*—Harness, Dickey & Pierce

[57] ABSTRACT

An automated lapping system employing a rotating table with a horizontal lapping surface and one or more parts tracks with escapement mechanisms for regulating the rate at which parts cross the lapping table. Each parts track is suspended above the rotating surface of the table, and confines the parts to move in single file across the surface of the rotating table. Multiple stations are provided along each track to cause each part passing through the track to stop for a predetermined amount of time at each station. The escapement mechanisms control the stopping and releasing of the parts along each track at the stations. Selected stations, called powered lapping stations, are provided on each track for applying positive downwardly-directed pressure to the part stopped at the station. These powered lapping stations and the escapement mechanisms preferably employ hydraulic or pneumatic cylinders for actuators. All of the powered lapping stations and escapement mechanisms associated with a single track may be operated by a common set of directional control valves.

20 Claims, 4 Drawing Sheets

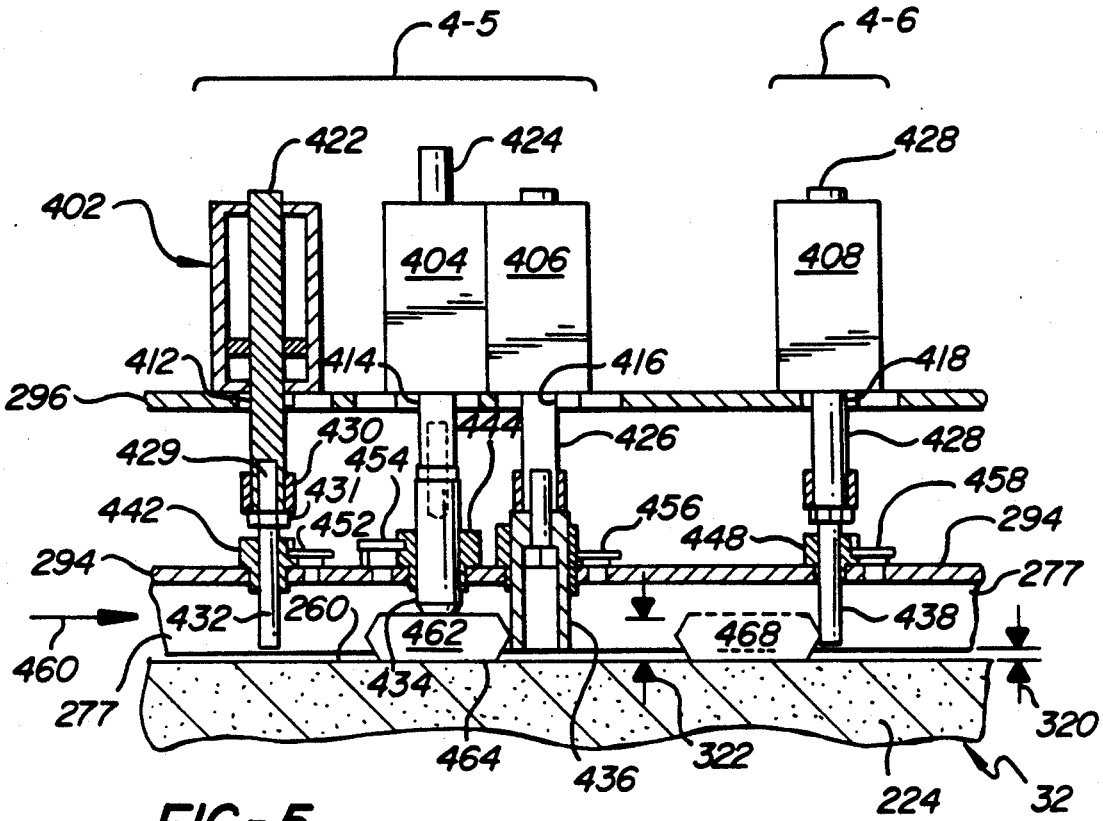
FIG-5
FIG-6
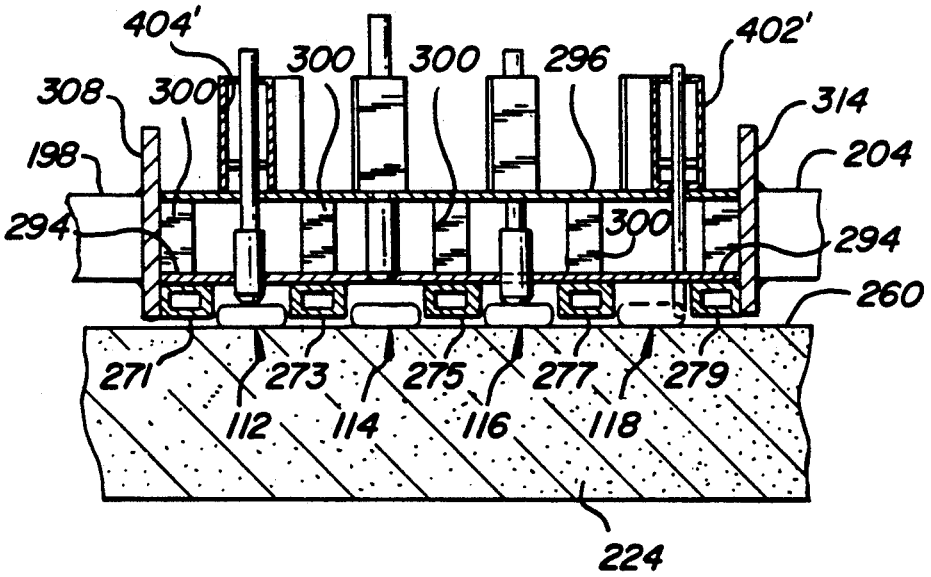

FIG-7
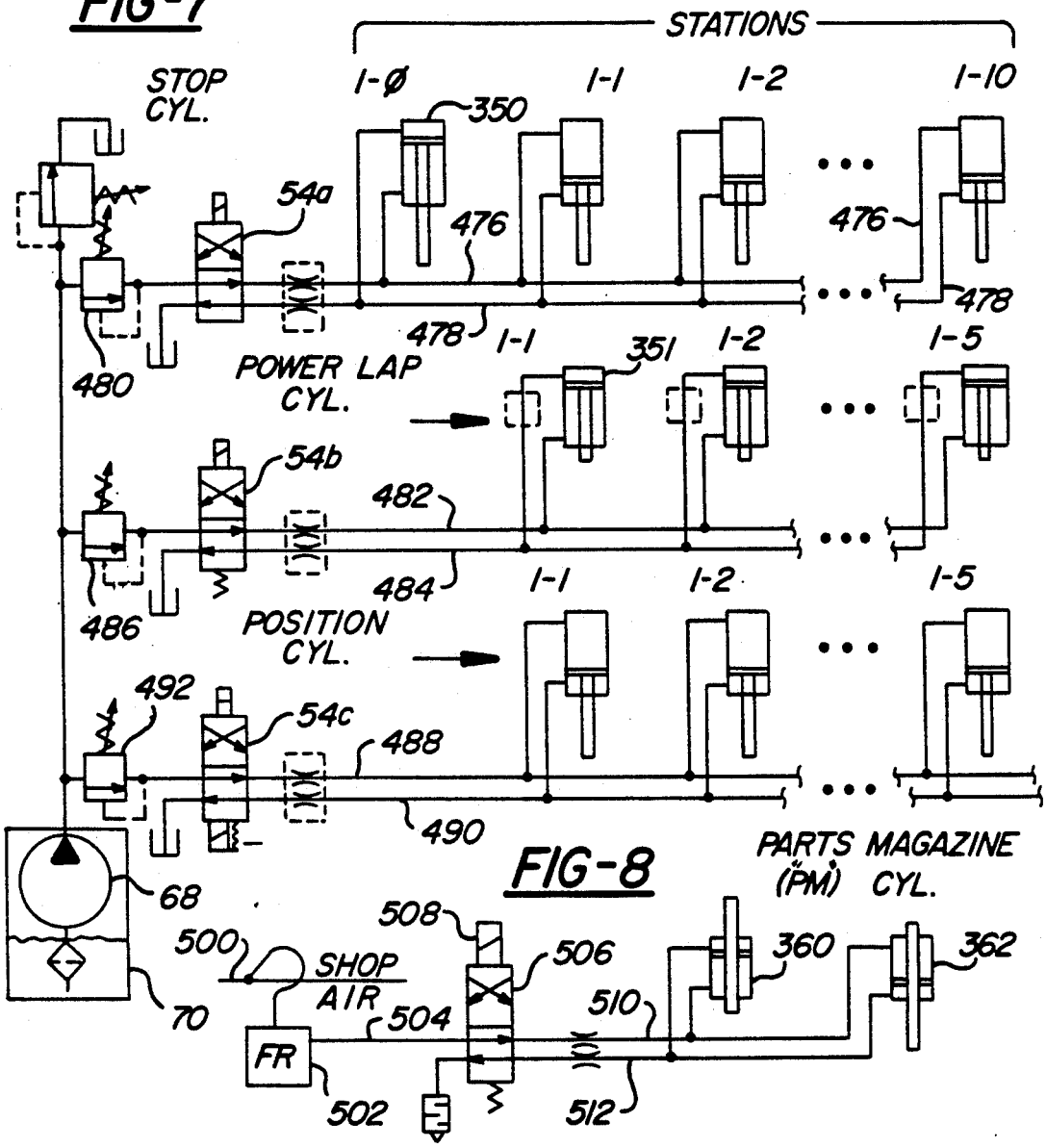
FIG-8
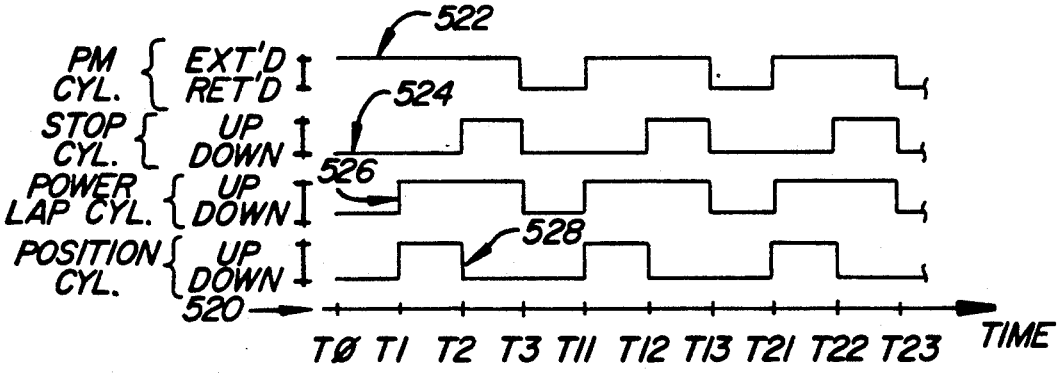
FIG-9

THRU-FEED LAPPING APPARATUS

BACKGROUND OF THE INVENTION

1. Field of the Invention

The present invention relates in general to automatic lapping machines, and in particular to automatic lapping machines which feed one or more streams of parts onto and off of a lapping table without human intervention.

2. Description of Related Art

Traditional lapping machines have a large horizontally-arranged, generally circular table provided with multiple, pie-shaped lapping stone sections arranged around a common central vertical axis. A suitably sized electric motor provides the motive power to rotate the table through a conventional clutch-brake and gear reducer combination. The lapping table may include two, three or four heavy conditioning rings equiangularly spaced around the table. The lower annular slotted surface of each conditioning ring rubs against the table and serves to help keep the surface of the lapping stones very flat. A supply of conventional lapping compound and cleansing lubricant is continuously pumped onto the table by a recirculating pump system to help carry away metal lapped off the parts being processed and any disintegrated lapping stone. This fluid is filtered to remove the fine metal particles and debris suspended in the fluid, and then is recirculated. The conditioning rings themselves are held in place by conventional roller retainer wheels supported by a simple superstructure suspended above or to the side of the table. Mechanical or fluid-power means such as a hydraulic cylinder may be provided for raising or lowering one or more of the conditioning rings relative to the lapping surface of the table. The retainer wheels preferably include ball or roller bearings, and may be strategically placed about the inner circumference of the conditioning ring so that the conditioning ring can readily rotate about its own axis as the table rotates beneath it. This rotation of the conditioning rings is induced by the frictional forces caused by the rotation of the table.

On a conventional lapping machine having four conditioning rings, only one or two of the rings are used for containment of parts being lapped. The remaining conditioning rings are not used for machining parts. Instead, they are employed to help condition the table surface and uniformly distribute lapping compound and lubricant on the lapping table. Parts having a generally flat bottom surface that is to be lapped are placed within one or two of the conditioning rings. As the table rotates, the conditioning rings and parts to be lapped each continuously revolve about their own central vertical axes, thus assuring a smooth and uniform lapped finish over the entire bottom surface of each part being lapped.

One long-standing problem presented by the conventional lapping machines designed as just described relates to the loading and unloading of parts being lapped. Lapping cycles vary greatly, depending upon the parts the material they made of, and the quality of the finish desired, from as low as about one minute up to several hours. However, during a typical lapping cycle of five or ten minutes, for example, a significant amount of cycle time is required to start and stop the table, and unload and load of the parts. Traditionally, the individual parts have been removed from the conditioning rings and inserted into the conditioning rings manually.

One technique for loading parts is to place them by hand in a circular configuration on a flat board. When the conditioning ring is in an elevated state, the board is then placed under the raised ring in the area normally occupied by a conditioning ring. The ring is then lowered, and the table is started up, so it begins to rotate again. To unload finished parts, the process is reversed.

Recently, automatic loaders for such machines have been provided which shuttle the rings in and out of the table onto flat load/unload surfaces at the same height as the table's lapping surface. Although the table still rotates, the ring containing parts are to be removed from the lapping machine is no longer in productive use when that lapping ring is moved off of the table onto a nearby loading/unloading platform. The net result is a significant loss of productivity when a ring is being loaded or unloaded, even though the table continues to rotate, since no parts are being lapped within that ring for as long as it takes to unload the ring, and load it with new parts.

As part of the conventional lapping processes described above, a large and heavy one-piece weight plate is typically placed over the many parts within an individual conditioning ring. If desired, a piece of cushioning material such as synthetic felt may be placed between the parts and weight plate. In this situation, the tallest parts are necessarily subjected to heavy forced lapping first, since all or most of the weight of the plate bears down on these taller parts. Those parts of lower height are lapped only by the force gravity exerts on the part until the higher parts are lapped down to a uniform height, at which time the weight of the plate begins to bear down on those parts as well. This approach to lapping parts necessarily requires a lapping cycle sufficiently long to ensure that the taller parts are lapped down to the height of the shorter parts, and that the lower-height parts will then receive a minimum desired amount of lapping, as required to obtain the desired surface finish.

In light of the foregoing shortcomings of prior art lapping systems, it is a primary object of the present invention to provide a lapping system and method which allows parts to automatically be loaded onto and automatically removed from a rotating lapping table having a horizontal lapping surface without human intervention. It is a related object of the present invention to provide a lapping apparatus which causes parts to be lapped to move single file in one or more streams across a lapping table, by action of the rotating table rubbing on the parts to be lapped.

It is a further object of the present invention to provide a parts track to guide the parts in a single file across the table. A related object is to provide escapement mechanisms for controlling the timing of movement of the parts between specified locations, which may be called stations, located along the parts track, so as to closely regulate the amount of lapping each part receives. It is another object of the present invention to provide multiple tracks and escapement mechanisms for feeding parts to be lapped in parallel streams across a rotating lapping table.

It is yet another object of the present invention to provide individual powered lapping stations where a positive downwardly-directed force is selectively applied to a part to be lapped to increase the rate of material removal from the lapping table. One more object of the present invention is provide a lapping system capable of efficiently lapping parts of uneven height in a minimum amount of time.

SUMMARY OF THE INVENTION

In light of the foregoing problems and in order to fulfill the foregoing objects, there is provided a thru-feed lapping apparatus. The apparatus comprises: a power-driven lapping table having a smooth, substantially continuous, generally cylindrical lapping surface, first track means for automatically guiding parts having at least one surface to be lapped across the lapping surface of the table; and first automatically-operated escapement means for selectively blocking the forward movement of parts to be lapped through the first track means, and for selectively releasing parts to proceed along the first track means. The foregoing automatic thru-feed lapping apparatus preferably has multiple tracks for feeding parts to be lapped across the table. The tracks are preferably straight and arranged parallel to one another.

The thru-feed lapping apparatus of the present invention may be retrofitted onto existing lapping machines by removing one or two of the conventional conditioning rings from a lapping machine and replacing them with two or more substantially straight tracks that are parallel to one another. In a prototype apparatus of the invention, four parts tracks are used. However, the number of tracks may vary from one to as many as may be as may be accommodated on the available space of the lapping table. The precise number of tracks may well be dictated by the effective working radius of the table in comparison to the size of the part.

In our preferred design, commonly-operated multiple escapement mechanisms are provided along each parts track for selectively blocking progress of parts to be lapped while such parts are guided by the track. These escapement mechanisms each selectively stop the part for a predetermined period of time, and then release the part so that it may proceed along the parts tracks. The escapement mechanisms are spaced from one another along the track, and each includes at least one mechanical stop movable between a blocking position where the parts are stopped and a "clear" position which allows the parts to proceed in a forward direction along the track.

To speed up the operation of the lapping machine, powered lapping means may be provided. Basically, at each location of the track where more vigorous lapping of parts is desired, a hydraulic or pneumatic power cylinder may be utilized to provide positive downwardly-directed pressure to bear upon the top of the part. This produces a much more vigorous lapping action on the bottom surface of the part which bears against the lapping surface of the table. Such locations may be called powered lapping stations, and will typically be provided along the early stations of the track. Each such station may apply a predetermined amount of force onto the part to provide for a rough lapping stage within the continuous operation. A number of rough lapping stages can be provided, and if desired, each may have a tailored force to achieve a desired amount of lapping at a particular location of the lapping track. Then, at later stations along the track, gravity alone may be utilized to provide the downward force upon the parts, so as to produce a smoother finish on the lapped surface of the part.

The location of the various stations may be staggered along the parallel tracks, so as to provide for substantially equal wear on the lapping surface of the table at various radii from the center of the table, and to provide for equal lapping of the parts no matter which track they may move along. Also, since there is less linear travel across the lapping surface provided by the outer tracks, the lapping stations of the outer tracks may need to be placed closer together.

These and other objects, advantages and aspects of the present invention may be further understood by referring to the detailed description, accompanying figures, and appended claims.

BRIEF DESCRIPTION OF THE DRAWINGS

The drawings form an integral part of the description of the preferred embodiments and are to be read in conjunction therewith. Like reference numerals designate the same or similar components or features in the various Figures, where:

FIG. 5 is an enlarged side view of a set of escapement mechanisms associated with a typical rough lapping station and a typical finish lapping station taken along line 5—5 of FIG. 3;

FIG. 6 is an enlarged cross-sectional view of the parts tracks taken along line 6—6 of FIG. 3;

FIG. 7 is a circuit diagram of a representative portion of a preferred hydraulic control system used to operate the escapement and powered lapping cylinders at the various lapping stations along a single parts track;

FIG. 8 is circuit diagram of a representative portion of the pneumatic control system of the present invention used to operate the escapement cylinders on a typical parts loading magazine; and FIG. 9 is a timing diagram illustrating one way of operating the escapement mechanisms of the loading magazine and escapement mechanisms of one of the FIG. 3 parts tracks.

DETAILED DESCRIPTION OF THE PREFERRED EMBODIMENTS

An exemplary automated thru-feed lapping system will now be described with respect to the Figures. While the apparatus which will be described is the presently preferred embodiment of the invention, those in the art should appreciate it is susceptible to variation, modification and improvement without departing from the broader scope of our invention.

Figures 1, 2:
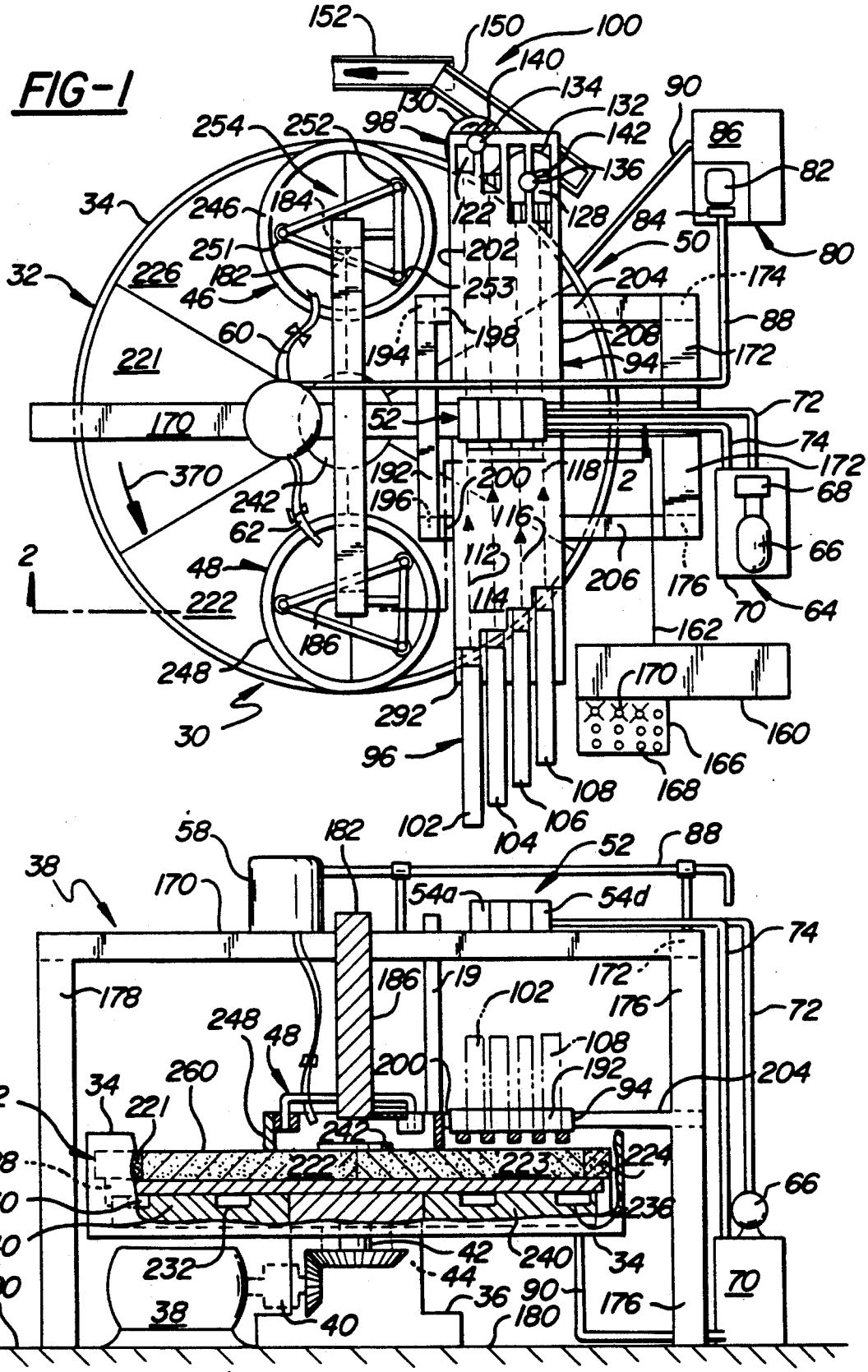
FIG. 1 is a simplified top view of an automatically loaded and unloaded lapping system of the present invention, which includes four parallel tracks for routing parts in single file fashion over predetermined paths across the table, and which may also include multiple station escapement mechanisms along each path.
FIG. 2 is a simplified side view of the FIG. 1 system shown in partial cross-section taken roughly along line 2—2 of FIG. 1, which illustrates the superstructure supporting the four parallel tracks.

FIGS. 1 and 2 show a simplified top and plan view of an automatically loaded and unloaded thru-feed lapping system 30. The system 30 includes a rotating lapping table 32 surrounded by a circular trough 34 which contains and captures lapping compound applied to the table. Any conventional lapping table may be used with the thru-feed lapping system of the present invention, such as a Lappmaster table or Speedframe table. The table is supported by a conventional base 36, shown in FIG. 2. The table is driven by an electric motor 38 through a conventional clutch and gear-reducer combination 40, which translates the high-speed rotation of motor 38 into a suitably slower speed rotation of vertical drive shaft 42, which may be driven by any suitable gear arrangement, such as gears 43 and 44. The table 32 may rotate at a suitable speed such as 60 to 150 rpm.

The superstructure 45 supports conditioning ring assemblies 46 and 48 and the parts track assembly 50 above the table 32, and a set 52 of hydraulic valves 54*a*-54*d*, and a small reservoir 58 for lapping compound distributed by flexible tubing 60 and 62 to the lapping rings 46 and 48. A conventional hydraulic power supply 64, including electric drive motor 66, hydraulic pump 68 and reservoir 70, are connected to the valves 54 by supply and return conduits 72 and 74. A conventional recirculating lapping compound filter system 80 includes an electric drive motor 82, pump 84 and reservoir 86 connected by supply and return conduits 88 and 90.

The parts track assembly 50 includes a main section 94, a load magazine section 96, and a parts removal section 98 which feeds parts to take-away conveyor system 100. There are four magazine tracks 102, 104, 106 and 108 which feed parts into four distinct part tracks whose center lines are represented by dashed lines 112, 114, 116 and 118. After the parts from magazines 102–108 pass through their respective tracks 112–118, they drop through respective openings 122–128 onto revolving turntable platters 130 and 132 driven by electric motors 134 and 136. The dropped parts then contact stationary stops 140 and 142, which force them to drop onto endless belt conveyor 150, which carries them to endless belt conveyor 152, that takes them to the next operation, which may be a washing machine that removes the lapping compound from the finished parts.

As shown in FIG. 1, the system 30 may also include an electric control panel 160, which may be connected by suitable electrical conductors in conduit 162 to the valves 54. Other conduits (not shown) may provide electrical power and control signals from the control panel 160 to other electrical devices such as motors, limit switches, solenoids and the like, located on the machine. An operator control station 166 including pushbuttons such as button 168 and indicator lights such as light 171. The electrical control panel 160 and operator station 166 may be constructed of conventional control components and include timing, and logic control circuits to operate the machine in the manner described herein. The design and construction of the control panel 160 and operator station 166 needed to implement the automatic operation of the lapping system 30 is well within the skill of those in the art once the automatic operation of the machinery is described with respect to FIGS. 1 through 9. Thus the control circuitry need not be described further, other than to note that it may be implemented using any conventional or suitable components, such as electromechanical relays, modular solid-state control circuits or by a computerized system having a suitable number of inputs and outputs, such as any one of several programmable controllers now in common use in many different types of industrial machinery.

The superstructure 45 includes a main top horizontal member 170 supported by transverse horizontal member 172 connected to vertical support columns 174 and 176. The left end of beam 170 is supported by vertical support column 178. Vertical beams 174–178 are suitably bolted to the floor 180. The conditioning ring assemblies 46 and 48 are supported by central transverse horizontal beam 182 which has vertical beams 184 and 186 connected to and extending downwardly from either end thereof.

The superstructure 45 also includes top transverse member 192 supported by beam 170. Vertical members 194 and 196 extend downwardly from either end of beam 192. Short beams 198 and 200 extend outwardly to the inner elongated side 202 of main section 94 of the parts track assembly 50. Longer horizontal beams 204 and 206 respectively extend from vertical legs 174 and 176 to the outer elongated side 208 of main section 94. Thus, short horizontal beams 198 and 200 and long horizontal beams 204 and 206 support and suspend the parts track 50 a predetermined distance above the table 32, as is best seen in FIG. 2.

The lapping table 32 is preferably made of a plurality of pie-shaped lapping stone sections 221 through 226, which may be supported by a common cylindrical metal plate 228, which may in turn be supported by any suitable means, such as rollers 230 through 236, provided under the table and supported by stationary cylindrical frame 240 that is part of the base 36. A central section 242 may be provided if desired in the center of table 32 into which the vertices of the pie-shaped stone sections 221–226 are anchored. The pie-shaped lapping stone sections 221–226 may comprise substantially identical, generally pie-shaped, equiangularly lapping stone sections arranged about the central vertical axis of the lapping table, the pie-shaped lapping stone sections each having an upper, planar surface, with all of such upper planar surfaces of these stone sections forming the substantially continuous lapping surface.

The conditioning ring assemblies 46 and 48 may have large, conventional conditioning rings 246 and 248 made of hardened steel. The rings 246 and 248 rest against the table and are supported for rotation about their centers by three roller wheels such as wheels 251, 252 and 253 supported by triangular frame 254 connected to stationary vertical member 184 in any conventional manner. If desired, the frame 254 may include a conventional fluid power cylinder (not shown) for raising and lowering the lapping ring 246 off of the horizontal surface 260 of the table 32.

Figure 3:
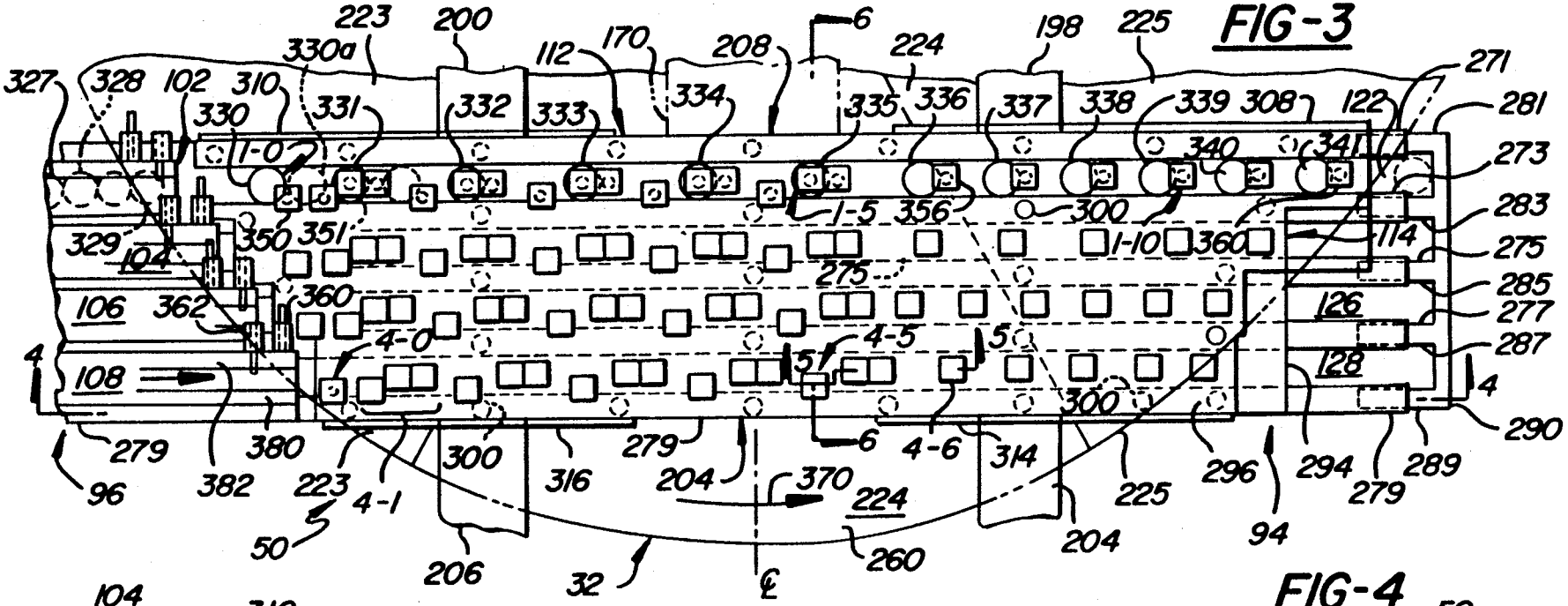
FIG. 3 is an enlarged top view of the four parallel tracks of the FIG. 1 system, which shows a preferred arrangement of escapement mechanisms on each track, and which also shows parts in typical lapping positions in the innermost track.
Figure 4:
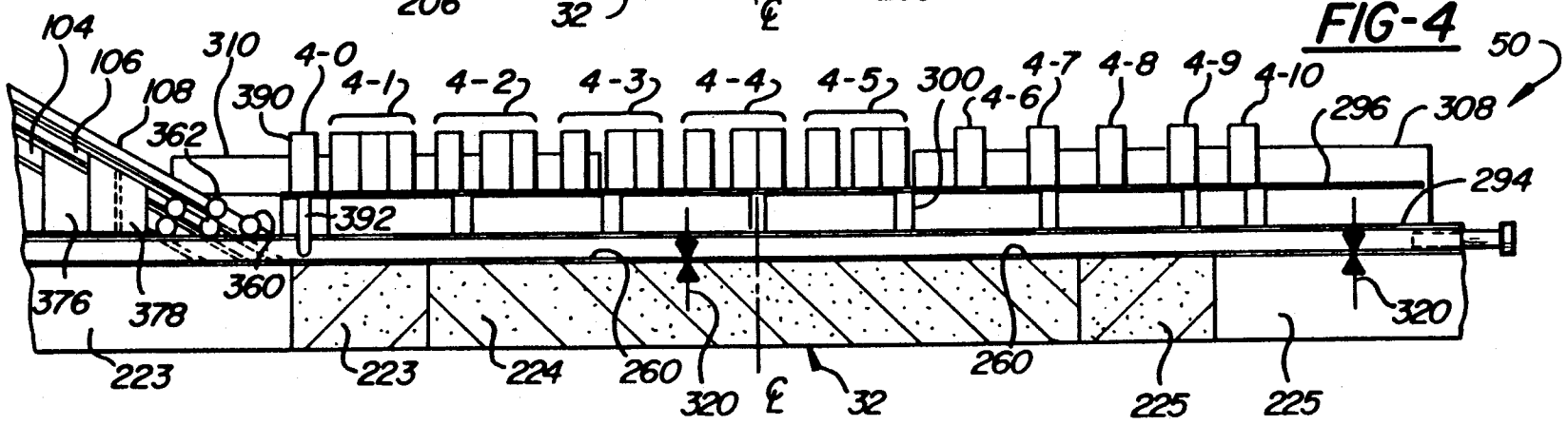
FIG. 4 is a side view of the outermost parts track and its escapement mechanisms, as taken along line 4—4 of FIG. 3.

FIGS. 3 and 4 are enlarged plan and side views respectively of the parts track assembly 50 showing its overall construction and the arrangement of various escapement mechanisms on the main parts tracks and loading magazines. The details of the main section 94 and four parts tracks 112–118 will be described first, followed by a description of the arrangement of the individual lapping stations on the tracks.

The main section 94 includes five elongated rectangular tubular frame members 271, 273, 275, 277 and 279 into which are fit complementary rectangular members 281, 283, 285, 287 and 289 that may each be rigidly connected to tubular cross piece 290. The opposite ends of the rectangular tubes 271–279 are respectively connected to the end piece 292, shown in FIG. 1.

Main section 94 also includes lower and upper plates 294 and 296 which extend horizontally over substantially the entire length of elongated tubular members 271–279. The plates 294 and 296 are kept apart from one another by cylindrical spacers 300 placed at regular intervals between the upper and lower plates 294 and 296. The plates 294 and 296 may be held together by any suitable means, including threaded holes in lower plate 294, and tie bolts passing through holes in upper plate 296 and extending through the centers of cylindrical spacers 300. Two vertical reinforcing plates 308 and 310 may be provided along inner side 208 of main section 94. Similarly, vertical reinforcing plates 314 and 316 may be provided along outer side 204 of main section 94 as shown in FIG. 3. Horizontal support members 198 and 200 may then be welded or otherwise rigidly attached to reinforcing plates 308 and 310. Similarly, horizontal support members 204 and 206 may be bolted or otherwise rigidly fastened to reinforcing plates 314 and 316 as shown in FIG. 3. In this manner, the frame 94 is rigidly suspended a fixed distance or height 320 above the surface 260 of table 32. This distance may be anywhere from 0.5 centimeters (cm) to 5.0 cm or more, and is dictated by the overall height of the parts to be lapped. For example, where the part to be lapped is only about 1.5 cm high, the gap 320 may be in the range from 0.5 cm to 1.0 cm. This relationship is shown more clearly in FIG. 5 which shows the gap 320 in comparison to the height 322 of the part shown in phantom there.

FIG. 3 also shows that the first through fourth parts tracks 112–118 are respectively formed by adjacent pairs of elongated tubular members or rails 271–279. For example, the first or innermost parts track 112 includes rails 271 and 273, the second parts track 114 is formed by rails 273 and 275, the third parts track 116 is formed by rails 275 and 277, and the fourth parts track 118 is formed by rails 277 and 279.

In FIG. 3, parts are shown in various positions along the first loading magazine 102 and the first parts track 112. For ease of understanding, the parts are shown in solid, as though the upper plate 296 did not exist. In practice, the plate 296 actually obscures the location of all of the parts in the first track 112 and the other tracks. The illustrated parts have a cylindrical shape when viewed from the top. The three complete parts shown in magazine 102 are numbered 327 through 329, while the parts along the first track 112 are numbered from 330 through 341. There are 12 distinct lapping stations along the first parts track 112, and the general locations of these lapping stations corresponds with the part 330 (station 1-0) through part 341 (station 1-11). The station 1-0 has a single cylinder assembly 350 associated with it, which is provided to ensure the orderly movement of parts from the magazine 102 into the station 1-1 which follows. Stations 1-1 through 1-5 are powered lapping stations, each of which includes three cylinder assemblies sequentially located one after another. Lapping stations 1–6 through 1–11 are finish lapping stations, and each has only one cylinder assembly associated with it.

A study of the second, third and fourth parts tracks 114, 116 and 118 in FIG. 3 reveals that they contain 10 stations, 11 stations and 10 stations respectively, including a transition station (station 0), five powered lapping stations (stations 1–5), and five or six finish lapping stations (stations 6–10 or 11). FIG. 4 shows the relative location of the cylinder assemblies of the fourth parts track 118 that are associated with transition station 4-0, power lapping stations 4-1 through 4-5 and five finish lapping stations 4-6 through 4-10.

FIG. 4 also shows that the loading magazines 102–108 are inclined at a sufficient angle, so that gravity will cause the parts to advance in a forward direction toward the table. As best shown in FIG. 3, each of the loading magazines 102–108 includes a pair of escapement cylinders, such as first and second cylinders 360 and 362 on the fourth parts tracks. The rods of the first and second cylinders are shown in opposite positions. This is meant to illustrate that whenever the rod of first cylinder 360 is in its retracted position, as shown in FIG. 3, the rod of second cylinder 362 is in its extended position. Similarly, when the rod of the first cylinder 360 is extended, the rod of the second cylinder 362 is retracted. A similar state of cylinder rods is shown by the escapement cylinders of the third magazine 106. The rod of the cylinder pairs associated with each magazine change state at the same time, with the net result being that parts stacked up in each magazine are ejected one at a time from the lower end of the magazine into its respective parts track. The table 32 rotates in the direction indicated by arrow 370. Frictional forces between the rotating table and the parts ejected onto the table from the magazines 102–108 cause the parts to advance in a forward direction along the respective parts tracks transition station (station 0), which is encountered promptly after being deposited upon the flat surface 260 of the table 32.

As shown in FIG. 4, each of the parts magazines may be supported by a suitable bracket, such as brackets 376 and 378 attached to lower plate 294 that respectively support magazines 106 and 108. The magazines, such as magazines 106 and 108, are preferably made of a pair of elongated U-shaped rails which face one another and are sized so as to contain the parts therein, while allowing the parts to slide by the action of gravity down the chute formed by the rails. Examples of the two rails are rails 380 and 382 which form parts magazine 108 shown in FIG. 3.

Those skilled in the art will appreciate that any suitable magazine design may be used, and that any suitable escapement mechanism which toggles parts one at a time out onto the table may be used with each magazine.

FIG. 3 helps illustrate the operation and function of the transition station 1-0. As shown there, the rod of cylinder 350 extends down into the opening of parts track 112 formed between rails 271 and 273, so as to block passage of the part 330 shown behind it. Retracting the rod of this cylinder will raise the rod out of the way of the part so that the part may advance to the next station where a part **330*a* is shown in dotted lines. This kind of relationship is also illustrated in FIG. 4, where the cylinder 390 associated with station 4-0 is shown with its rod 392 in an extended position, thus blocking movement of parts along the track 118 which are upstream of the rod 392. The operation of this transition station 0** cylinder assembly is also identical to that of the first cylinder in the group of three cylinders found at each lapping stations.

FIGS. 5 and 6 help further illustrate the operation of the various cylinder assemblies found on the FIG. 1 machine. In particular, FIG. 5 is a detailed cross-sectional view of the various components of cylinder assemblies taken along line 5—5 of FIG. 3. This corresponds to lapping stations 4-5 and 4-6 of the fourth parts track 118. FIG. 5 thus shows an enlarged view of powered lapping station 4-5 and finish lapping station 4-6 of the fourth parts track. The construction of this powered lapping station and of this finish lapping station are representative of the other powered lapping stations and finish lapping stations. Hence, when the operation of these two stations are understood, those skilled in the art will appreciate how all of the lapping stations found in automated parts tracks assembly 50 are constructed and individually operate.

FIG. 5 shows that the typical powered lapping station 4-5 includes three fluid power cylinders 402, 404 and 406, while the typical finish station 4-6 has only one fluid power cylinder 408. These four cylinders are rigidly attached by any conventional fasteners (not shown) to upper plate 296. The plate 296 has holes 412, 414, 416 and 418 which extend through the plate 296 so that cylinder rods 422–428 respectively associated with cylinders 402–408 can move freely up and down. All of the cylinder rods are shown in their lowered positions in FIG. 5. At the lower free end of each of the cylinder rods 422–428 is a replaceable tool assembly which comes in contact with the part to be lapped. Each of these tool assemblies is threaded into a bore such as bore 429 shown in cylinder rod 422. One or two locking nuts such as nuts 430 and 431 are provided on each of the cylinder rods to help prevent loosening of the end rod tool, such as tool 432, threaded into the respective bore of the cylinder rod. The tools 432–438 respectively provided on the ends of cylinder rods 422–428 are each guided by one of the bushings 442–448, threaded through corresponding holes in the lower plate 294. Locking screws 452–458 fit in corresponding arcuate hollows machined into the bushings 442–448, and prevent the bushings from being backed out due to vibration while the system 30 is operating. Locking screws 452–458 may be of any suitable or conventional variety and are preferably of the type that will not back out on account of vibration.

The function of end rod tool 432 is to stop parts traveling downstream, that is, in the direction indicated by arrow 460, until such time as they may be advanced to the position where part 462 is shown. End rod 434 bears down against the center of the part to be lapped and is used to apply extra downward force so that a correspondingly greater amount of material is lapped off of the bottom surface 464 of the part as the tble 32 continuously rotates. The rod 426 of cylinder 406 is used to stop the part 462 in the precise location desired prior to time that rod 424 of cylinder 404 is lowered. In the finish lapping stations, the end rod 438 is used to stop the part such as part 468 shown in phantom upstream of stop rod 438. The lapping of the part in location 468 is accomplished by the force of gravity acting upon the part so as to make it bear against the lapping surface of the table. Worn end tooling 432–438 shown on the ends of cylinder rods 422–428 may be periodocally replaced as necessary. In order to reduce the amount of wear on the parts, this replaceable tooling may be wear-hardened using any conventional or suitable technique such as carburization, nitriding or induction hardening.

FIG. 6 shows the parts handling apparatus 50 in a transverse cross-sectional view taken along line 6—6 of FIG. 3. In this view, the power lapping cylinder 404, is shown in the lowered position for first and third tracks 112 and 116 and in the raised positions for the second track 114. Also, the vertical reinforcing plates 308 and 314 and the cylindrical spacer members 300 may be seen in this view separating the lower and upper plates 294 and 296 by a predetermined distance.

FIG. 7 shows a part of a typical hydraulic system which may be used to operate the cylinders associated with one of the tracks of part handling apparatus 50, such as the first track 112. The hydraulic system used to operate each of the other parts tracks may be substantially identical. As previously explained, there are three different types of cylinders, namely stop (or "load-station") cylinders, power lap cylinders and position (or "unload-station") cylinders. Specifically, as shown in FIG. 3, the first parts track 112 has eleven stop cylinders, five power lap cylinders and five position cylinders. All of the stop cylinders may be operated by a common two-position, four-way solenoid-operated, spring-returned directional control valve **54*a* which supplies fluid via the common lines 476 and 478 to the eleven cylinders 350–360 associated with station 1-0 through station 1-10. A separate pressure reducing valve 480 may be utilized to control the amount of pressure in the hydraulic fluid being applied to the cylinders. A second directional valve 54*b* is used to operate the powered lapping cylinders associated with stations 1-1 through 1-5 via hydraulic conduit or lines 482 and 484. A common pressure-reducing valve 486** may be used to control the amount of hydraulic pressure to these lines.

The third set of cylinders, namely the position cylinders, are operated by another directional valve **54*c* which supplies hydraulic fluid via lines 488 and 490 to the position cylinders associated with stations 1-1 through 1-5. Once again, a pressure reducing valve 492 may be provided if desired to control the pressure of hydraulic fluid delivered to the position cylinders. The hydraulic circuit of FIG. 7 shows that the stop cylinders of the first parts track operate in unison, all of the power lap cylinders of the first parts track operate in unison, and all of the position cylinders of the first parts track operate in unison. This simplifies the designing of controls to operate the parts handling apparatus 50** by reducing the number of hydraulic directional valves required to operate the system.

Those in the art will appreciate that the hydraulic circuit for operating the other parts tracks may be substantially identical to the circuitry shown in FIG. 7. Alternatively, if desired, the stop cylinders of one or more of the other tracks may be operated in parallel off of lines 476 and 478 for one or more of the other tracks. For example, the first and third tracks might be caused to operate in unison and the second and fourth tracks might be caused to operate in unison. In this manner, the number of hydraulic components can be reduced still further.

FIG. 8 shows a typical pneumatic circuit for operating the escapement mechanisms for one of the load magazines, such as magazine 108. Specifically, FIG. 8 shows that pressurized air on shop air line 500 is supplied through a conventional filter regulator unit 502 to line 504 which supplies two-position, four-way, solenoid-operated, spring-returned directional valve 506 with pressurized air, which is then fed through lines 510 and 512 to a pair of escapement cylinders, such as cylinders 360 and 362, associated with magazine 108. Thus, whenever the solenoid 508 of valve 506 is energized, pressurized air from regulator 502 is diverted from line 510 to the opposite line 512, which causes the cylinders 360 and 362 to change state. Thus, each time the valve 506 is cycled by energizing and de-energizing solenoid 508, another part to be lapped is cycled out onto the table.

FIG. 9 is a timing diagram which shows one preferred method for operating the stop, power lap and position cylinders of a common parts track, such as parts track 112, in a coordinated fashion so as to process a maximum number of parts in a minimum time. In FIG. 9, the state of each of these types of cylinders is shown at each instant along a common time 520, which depicts three successive cycles during the operation of the system 30. Time T0 shows the states of the rods of the various cylinders of parts track 112 in their initial position. The first complete cycle of operation involves three identifiable cylinder transition times, namely times T1, T2 and T3. The second complete cycle is a duplicate of the first cycle, and for clarity its transition times are labelled as times T11, T12 and T13. The third and subsequent cycles are identical to the first cycle as well. For clarity, transition times of the third cycle are labelled T21, T22 and T23. The line 522 shows the position or state of the rod of parts magazine cylinder 362, i.e., the rod is either extended, which blocks the part, or is returned, which releases the part. The line 524 shows the state of the rod of each of the stop cylinders of stations 1-0 through 1-10, which either are all up, thereby allowing parts to pass thereunder, or are all down, thereby blocking the passage of the parts through the stations associated with the cylinders. In a similar manner, lines 526 and 528 respectively represent the states of rods of the powered lapping cylinders of stations 1-1 through 1-5 and the position cylinders of stations 1-1 through 1-5, which move up and down at selected transition times as shown. The periods between the transition times may be adjusted as desired to achieve the desired amount of lapping time at successive stations, and to ensure that the parts moving along the parts track are stopped as desired upstream of each lowered cylinder rod. Conventional adjustable analog or digital electronic timers may be used within the control panel 160 shown in FIG. 1 to set these times as desired.

An overall advantage of the thru-feed operation of the present invention is that the parts never need to be removed from the tracks, and thus can be automatically fed, without human intervention into a subsequent operation, such as a washing machine to remove the lapping compound from the part before additional machining or assembly steps. Another advantage is that the parts loading mechanism, since it is a magazine or track, can receive parts, without human intervention, from another earlier automation station.

All of the lapping stations of the present invention may be functionally identical, except some do not utilize power cylinders to promote more vigorous lapping action. In particular, the finishing stations where the weight of the part alone is sufficient to produce the desired lapping rate, it is not necessary to use the power cylinders.

The staggering of the locations of stations along the four tracks may be used to provide for equal lapping of parts no matter which track they move along. This may be accomplished as shown by crowding more lapping locations along the outer track, since there is less linear travel across the lapping wheel provided at that point. As will be appreciated, the locations of the various lapping stations can be varied along the individual tracks as desired to produce the desired amount of lapping.

As may be seen from the plan view of the lapping table in FIG. 1, there is room for providing one or more lapping tracks on the opposite side for finishing parts there. This may be accomplished by adding the additional lapping tracks to the left on the conditioning rings 46 and 48. The parts would be fed through in a direction which permits the rotation of table 32 to cause the parts to move from station to station, as is done with parts track assembly 50. Those skilled in the art will appreciate that a part that must be lapped on both sides can simply be turned over in a suitably designed power conveyor and run back through the machine on another track so that 2-sided lapping can be accomplished substantially continuously on a sequential basis using this invention.

Using the conventional technology described in the background portion of this application, two persons were able to make 844 parts per hour on a conventional 84-inch lapping table. The parts in question were thrust plates or pressure plates for use in power steering pumps. With our new automatic thru-feed lapping system and process, which has been described above, the production rate has been increased for these same parts to about 1300 parts per hour with only one person loading the machine having the automatic thru-feed lapping system and process. Unloading is accomplished automatically as described above. The finished quality at this higher rate of production is at least as good as that achieved with the old process.

Another advantage of the present invention is that it appears to produce more uniform and quicker lapping of parts of uneven height. As explained above, the lapping system and method of the present invention provides for consistent uniform lapping of parts of varying heights since each part is treated individually as it proceeds through the feed-through lapping mechanism.

The foregoing detailed description shows that the preferred embodiments of the present invention are well suited to fulfill the objects above-stated. It is recognized that those skilled in the art may make various modifications or additions to the preferred embodiments chosen to illustrate the present invention without departing from the spirit and proper scope of the invention. For example, the number and orientation of the parts tracks may be varied. Also, different arrangements and spacings for the powered lapping stations may be utilized. Further, pneumatic rather than hydraulic cylinders may be used if desired to provide the positive downwardly-directed force against the parts. Accordingly, it is to be understood that the protection sought and to be afforded hereby should be deemed to extend to the subject matter defined by the appended claims, including all fair equivalents thereof.

We claim:

1. A power-driven automatic thru-feed lapping apparatus, comprising:

a generally cylindrical lapping table including a generally circular substantially continuous lapping surface arranged for rotation about a central vertical axis under power provided by a motor;

first track means for guiding parts having at least one surface to be lapped from an upstream location of such track means along a predetermined path across the lapping surface of the table to a downstream location of such track means, the first track means including a first parts track arranged in a generally straight first line perpendicular to preselected radial direction of the table at predetermined first distance to the center of rotation of the table;

first commonly-operated multiple escapement means, for selectively blocking progress of parts to be lapped while such parts guided by the first track means, and for selectively releasing parts to proceed along the first track means, such escapement means including first, second and third individual escapement mechanisms spaced from one another along the first track means, with each such escapement mechanism having at least one mechanical stop movable between a blocking position where parts are stopped and a clear position which allows parts to proceed in a forward direction along the first parts track;

second track means for guiding parts having at least one surface to be lapped from an upstream location of such track means across the lapping surface of the table to a downstream location along such track means, the second track means including a second parts track arranged in a generally straight second line perpendicular to preselected radial direction of the table at predetermined second distance to the center of rotation of the table, the second distance being greater than the first distance, whereby the first and second parts tracks are generally parallel to one another;

second commonly-operated multiple escapement means, for selectively blocking progress of parts to be lapped while such parts are guided by the second track means, and for selectively releasing parts to proceed along the second track means, such means including first, second and third individual escapement mechanisms spaced from one another along the second track means, with each such escapement mechanism having at least one mechanical stop movable between a blocking position where parts are stopped and a clear position which allows parts to proceed ina forward direction along the second parts track; and the individual escapement mechanisms of the second escapement means being generally closer to one another than the individual escapement mechanisms of the first escapement means such that the parts to be lapped in the second track means receive approximately the same amount of lapping action by the lapping surface of the table as the parts to be lapped in the first track means.

2. A thru-feed lapping apparatus as in claim 1, wherein the lapping table includes a generally cylindrical rotatable base and a plurality of substantially identical, generally pie-shaped, equiangularly lapping stone sections arranged about the central vertical axis of the lapping table, the pie-shaped lapping stone sections each having an upper, planar surface, with all of such upper planar surfaces of the stone sections forming the substantially continuous lapping surface.

3. A thru-feed lapping apparatus as in claim 1, further comprising:

first powered lapping means, associated with a selected escapement mechanism of the first multiple escapement means, for selectively applying a predetermined amount of positive downwardly directed pressure in excess of gravity to a single part moving through the first track supplied by gravity upon a part to be lapped at such escapement mechanism, and second powered lapping means, associated with a selected escapement mechanism of the second multiple escapement means, for selectively applying a predetermined amount of positive downwardly-directed pressure in excess of gravity to parts moving through the second track supplied by gravity upon a part to be lapped at such escapement mechanism.

4. A thru-feed lapping apparatus as in claim 3, wherein:

each powered lapping means for applying a predetermined amount of additional downward force includes a fluid cylinder means for applying in a vertical direction a force through a piston to a piston rod.

5. A thru-feed lapping apparatus as in claim 1, further comprising:

first valve means for synchronously operating said first, second and third escapement mechanisms of the first multiple escapement means; and second valve means for synchronously operating said first, second third escapement mechanisms of the second multiple escapement means.

6. A thru-feed lapping apparatus as in claim 5, in which each valve means includes an electrically-operated valve.

7. A thru-feed lapping apparatus as in claim 6, further comprising:

control means for generating timed electrical signals to operate the electrically-operated valves of the valve means.

8. A thru-feed lapping apparatus as in claim 1, wherein the first and second tracks each include inner and outer guide rails, with the space between the guide rails being sized to allow parts having a substantially cylindrical side surface to rotate therein in response to forces applied to the parts by the lapping surface of the table.

9. A thru-feed lapping apparatus as in claim 1, further comprising:

first and second automatic part loading means, with each such loading means being associated with and feeding parts to be lapped into a respective one of the first and second track means, and each such loading means including an inclined chute and an escapement mechanism arranged to periodically drop a part to be lapped onto the lapping surface.

10. A thru-feed lapping apparatus as in claim 1, further comprising:

drive means for rotating the lapping table at a predetermined constant angular velocity, the drive means including an electric motor.

11. A thru-feed lapping apparatus as in claim 1, further comprising:

lapping compound dispenser means for automatically applying lapping compound to the lapping surface of the table; and a plurality of lapping ring means for distributing lapping compound and conditioning the lapping surface of the table, each such lapping ring means having a generally cylindrical annular ring provided with a planar lower surface positioned for in sliding contact with the lapping surface of the table, and rotation support means for enabling the annular ring to rotate in place about a fixed vertical axis.

12. A thru-feed lapping apparatus as in claim 1, wherein:

the number of lapping sections equals at least four, the speed of the table is at least about 60 revolutions per minute.

13. A thru-feed lapping apparatus, comprising:

a generally cylindrical power-driven lapping table having a smooth substantially continuous, horizontal lapping surface;

first track means for automatically guiding parts having at least one surface to be lapped across the lapping surface of the table;

first automatically-operated escapement means, for selectively blocking forward movement of parts to be lapped through the first track means, and for selectively releasing parts to proceed along the first track means; and said escapement means including a plurality of individual escapement mechanisms spaced from one another along the first track means with each such escapement mechanism having at least one mechanical stop movable between a blocking position where parts are stopped and a clear position which allows parts to proceed in a forward direction along the first parts track.

14. A thru-feed lapping apparatus as in claim 13, further comprising:

first means, associated with the first escapement means, for applying a predetermined amount of force against a part to be lapped to increase the pressure with which such part rubs against the lapping surface of the table.

15. A thru-feed lapping apparatus as in claim 13, wherein:

said first escapement means, for selectively blocking progress of parts to be lapped while such parts are on the lapping surface and confined by the first track means, and for selectively releasing parts to proceed along the first track means.

16. A method of automatically lapping multiple identical parts using a generally circular lapping table having a lapping work surface which rotates continuously about a central axis, comprising:

feeding the multiple identical parts to be lapped single file along a first predetermined path across the work surface of the rotating table;

at a first location along the first predetermined path, stopping the forward motion of a first part in the process of being lapped for a first predetermined amount of time; and then releasing the part to move along the path again; and at a second location along the first predetermined path spaced from the second location, stopping the forward motion of a first part in the process of being lapped for a first predetermined amount of time, and then releasing the part to move along the path again.

17. A method of automatically lapping as in claim 16, wherein the part being lapped in confined in a track and rotates about its own vertical axis as a result of the interaction of forces between the part, track and rotating work surface of the lapping table.

18. A method of automatically lapping as in claim 16, further comprising the step of:

applying, at one of the first and second locations along the first predetermined path, a positive downwardly-directed force such the part being lapped at such location is more forcefully lapped.

19. A method of automatically lapping as in claim 16, further comprising the step of:

feeding the parts to be lapped single file along a second predetermined path across the rotating table; and at a first location along the second predetermined path, stopping the forward motion of a second part in the process of being lapped for a predetermined amount of time, and then releasing the part to move along the path again; and at a second location along the predetermined path spaced from the second location, stopping the forward motion of the second part in the process of being lapped for a predetermined amount of time, and then releasing the part to move along the path again.

20. A method of automatically lapping as in claim 19, wherein the first and second predetermined paths are each arranged in a straight line, and such straight lines are parallel to one another.

* * * * *